United States Patent [19]

Delio et al.

[11] Patent Number: 4,555,925

[45] Date of Patent: Dec. 3, 1985

[54] METHOD AND APPARATUS FOR PREFORMING A BILLET WITH NO DRAFT AND NO FLASH

[76] Inventors: Ralph D. Delio, R.D. #1 Susan Trace, New Wilmington, Pa. 16142; Donald J. Diemer, 3665 E. 78th St., Cleveland, Ohio 44105

[21] Appl. No.: 619,121

[22] Filed: Jun. 11, 1984

Related U.S. Application Data

[63] Continuation-in-part of Ser. No. 500,886, Jun. 3, 1983, which is a continuation-in-part of Ser. No. 2,851, Jan. 12, 1979, Pat. No. 4,294,101.

[51] Int. Cl.[4] ..... B21D 22/00

[52] U.S. Cl. ..... 72/359; 72/352; 72/467

[58] Field of Search ..... 72/352, 354, 359, 360, 72/467

[56] References Cited

U.S. PATENT DOCUMENTS

| | | | |
|---|---|---|---|
| 3,098,292 | 7/1963 | Benk | 72/352 |
| 4,018,075 | 4/1977 | Kawawa | 72/467 |
| 4,166,373 | 9/1979 | Braun | 72/359 |
| 4,207,762 | 6/1980 | Kelly | 72/360 |
| 4,382,324 | 5/1983 | Halene | 72/359 |

*Primary Examiner*—Leon Gilden

*Attorney, Agent, or Firm*—Fay, Sharpe, Fagan Minnich & McKee

[57] ABSTRACT

A preheated billet (A) is disposed in a billet receiving region (20) of a lower die (B). The lower preforming die defines a throat region (30) which is smaller in transverse cross section than the billet receiving region and disposed immediately therebelow. The lower die further defines an enlarged relief region (40) which is larger in all transverse dimensions than the throat region and disposed immediately therebelow. An upper die (C) includes a billet engaging surface (50) which has substantially the same transverse cross section as the billet receiving region. The upper die is forced downward by a hydraulic press or the like into engagement with the billet. As the upper preforming die continues downward, the billet engaging surface is telescopically received within the billet receiving region pushing and deforming the billet ahead of it. With continued downward movement, the billet is forced into conformity with the billet receiving region and is extruded through the throat region to hang within the relief region. In this manner, a billet is formed in part in substantially conformity with the billet receiving region and in part untapered or draft-free with the cross section of the throat region.

17 Claims, 5 Drawing Figures

METHOD AND APPARATUS FOR PREFORMING A BILLET WITH NO DRAFT AND NO FLASH

BACKGROUND OF THE INVENTION

This application is a continuation in part of earlier filed application Ser. No. 500,886, filed June 3, 1983, which in turn is a continuation in part of earlier filed application Ser. No. 2,851, filed Jan. 12, 1979, now U.S. Pat. No. 4,294,101.

The present invention relates to forming metal parts. The invention finds particular application in forging gears or rollers which have an integral spindle or shaft and will be described with particular reference thereto. It is to be appreciated, however, that the invention has broader applications in forming other metal parts which have integral larger and smaller cross sectioned portions.

Heretofore, gears and rollers were forged with a multi-step process. A heated billet was descaled and positioned in a busting or preforming die pair to be preformed.

After the billet was preformed in the busting die pair, the billet was transferred to a blocking die assembly which was configured intermediate in shape between the busting die and a finishing die. An upper blocking die or mandrel was pressed against the billet in a lower blocking die forcing the billet into conformity therewith. In order to insure full conformity, the upper and lower busting dies were configured to allow the billet to form a flange or flashing therebetween.

Thereafter, the blocked billet was transferred to a finishing die pair which conformed it to the finished product. In order to accommodate the flashing and to insure full conformity, the finishing die pair was configured to allow an expansion of the flange or flashing.

Further, the lower blocking and finishing dies were configured with a draft or taper to enable the blocked or finished part to be removed. This draft caused the large and small portions of the part to have tapering cross sections. Additional machining operations were required to true the larger and smaller portions, eliminating the taper.

The present invention contemplates a method and apparatus of forging billets with closer dimensional tolerances to eliminate the above-referenced drawbacks.

SUMMARY OF THE INVENTION

In accordance with a first aspect of the present invention, there is provided a method of preforming a billet without draft and without flash. A billet which has a first cross section and other physical characteristics is heated and positioned in a lower die. The lower die defines: (i) a billet receiving region which has a transverse billet receiving region cross section, (ii) a throat region which has a transverse throat cross section smaller than the transverse billet receiving region cross section, and (iii) an enlarged, relief region which has a transverse relief region cross section larger than the transverse throat cross section. The heated billet is positioned in the preforming die billet receiving region and forced into conformity therewith by an upper die or mandrel. The billet is further forced partially through the throat region into the relief region. The billet is ejected from the lower die.

In accordance with a more limited aspect of the invention, an upper die which has substantially the same transverse cross section as the billet receiving region transverse cross section engages the billet to force it through the throat portion. The upper die forces the billet in part into conformity with the billet receiving region as another part of the billet is extruded through the throat region. The throat region is configured with the appropriate draft, longitudinal length, and the like, such that the force required to overcome the resistance to extruding the billet therethrough is less than the force required to force the billet between the upper and lower dies. In this manner, the billet is extruded through the throat and into the relief region without being forced between the upper and lower dies to form a flashing.

In accordance with another aspect of the present invention, there is provided a die combination for forming a billet without draft and without flash. The die combination comprises a lower die and an upper die. The lower die defines: (i) a billet receiving region extending longitudinally therein and having a transverse billet receiving region cross section, (ii) a throat region adjacent the billet receiving region and having a transverse throat cross section which is smaller than the transverse billet receiving region cross section, and (iii) an enlarged, relief region disposed adjacent the throat region and having a transverse relief region cross section which is larger than the transverse throat cross section. The upper die has an outer transverse cross section which is substantially the same as the transverse billet receiving region cross section such that the upper die is receivable within the lower die billet receiving region to force a billet received therein in part into conformity with the billet receiving region and in part through the throat region into the relief region.

One advantage of the present invention is that it facilitates precision forging operations.

Another advantage of the present invention is that it permits elimination of a conventional blocking step.

Another advantage of the present invention is that it forges gears and rollers which are free of flash and which have constant cross sectioned spindles.

Still further advantages of the present invention will become apparent upon reading and understanding the following detailed description.

BRIEF DESCRIPTION OF THE DRAWINGS

The invention may take form in various steps and arrangements of steps or in various parts and arrangements of parts. The drawings are only for purposes of illustrating a preferred embodiment of the invention and are not to be construed as limiting it.

DETAILED DESCRIPTION OF THE PREFERRED EMBODIMENT

Figure 2:
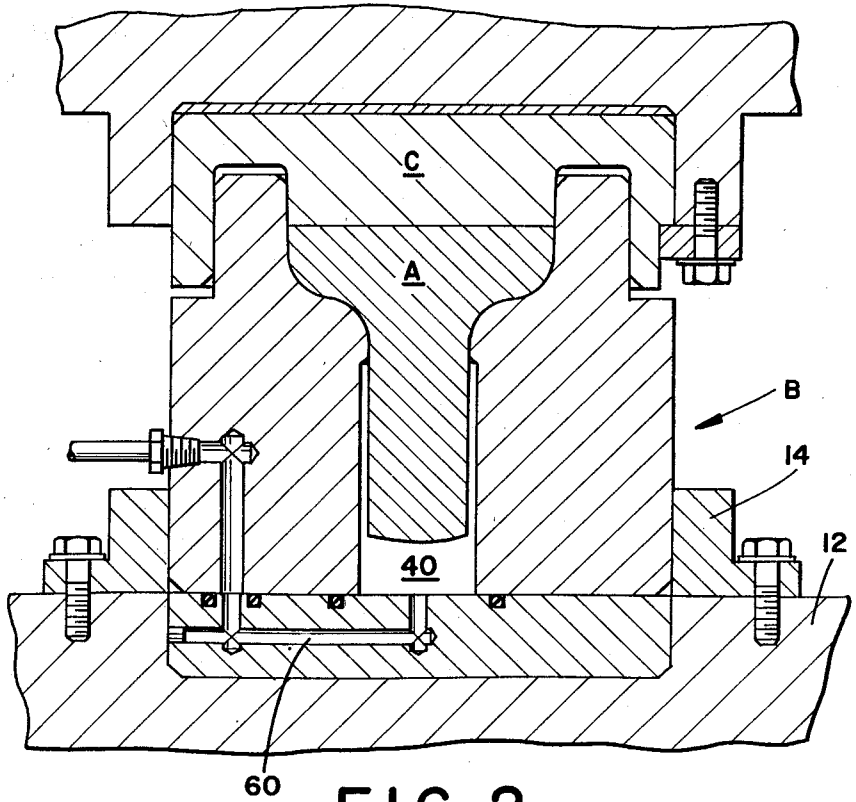
FIG. 2 is a side sectional view of the die assembly of FIG. 1 with the upper and lower dies fully closed.
Figure 1:
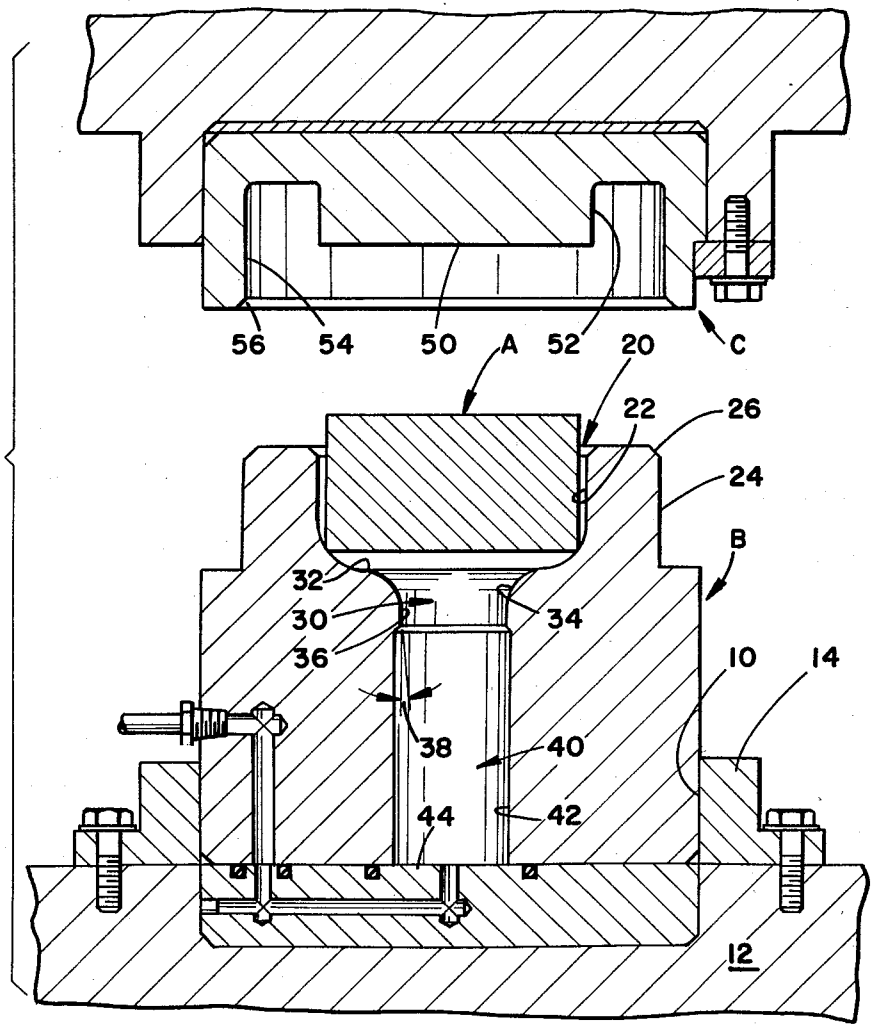
FIG. 1 is a side sectional view of a die assembly with the dies spaced apart receiving a billet therebetween in acccordance with the present invention.
Figure 4:
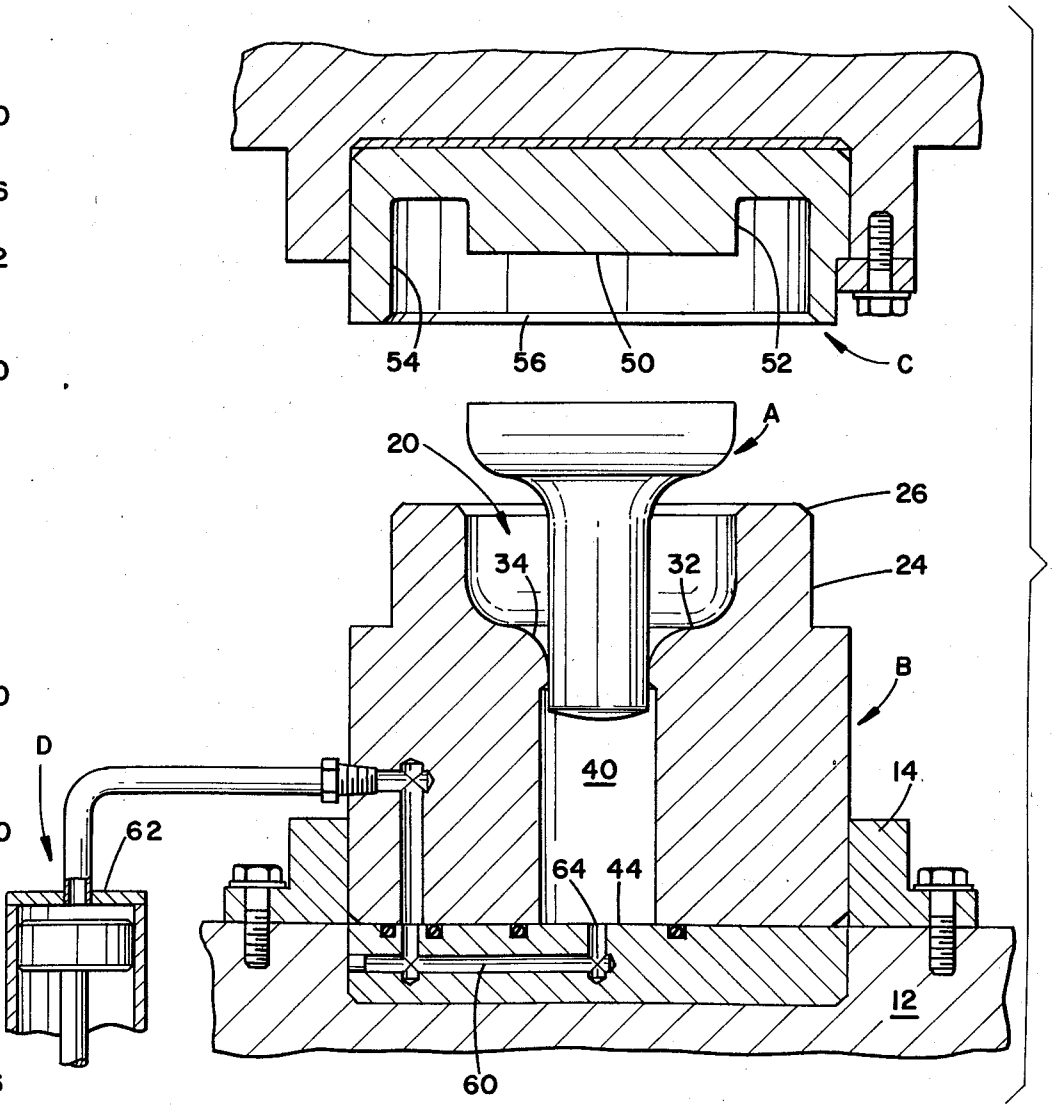
FIG. 4 is a side sectional view of the die assembly of FIGS. 1 and 2 with the formed part being ejected; and, FIG. 5 is a top view of an alternate embodiment of the lower die of FIG. 1.
Figure 3:
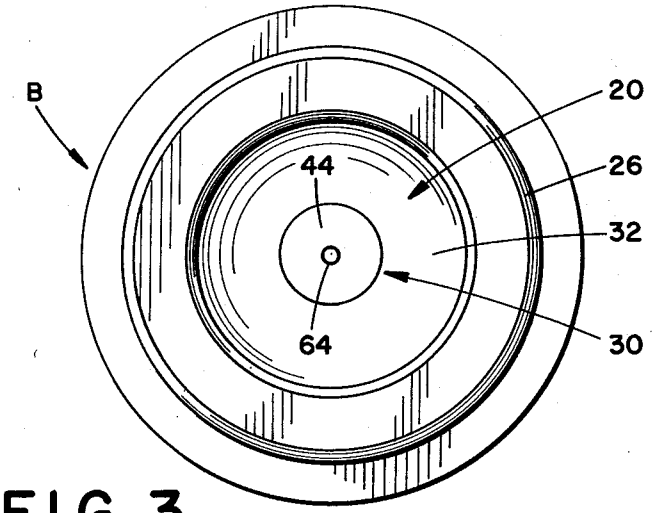
FIG. 3 is a top view of the lower die of FIGS. 1 and 2.

With reference to FIG. 1, a billet A is heat softened in a furnace, descaled, and positioned in a lower die B. With reference to FIGS. 2 and 3, an upper die C is urged downward with a hydraulic press, or the like, with sufficient force to deform and extrude the billet through and into conformity with the lower die block B. As illustrated in FIG. 4, the upper die block is raised and an ejection means D ejects the shaped billet.

With reference to FIGS. 1, 2, and 3, a lower die receiving well 10 is defined by a lower die block 12 and a lower die support ring 14.

The lower die B which is mounted in the die block well defines a billet receiving or major diameter region 20. In the preferred embodiment, the billet receiving region has a substantially cylindrical side wall 22 such that it defines a circular, transverse billet receiving region cross section along a substantial portion of the longitudal length thereof. The circular transverse cross section is ideally suited for the forging of gears and rollers. However, it is contemplated that the billet receiving region will have other cross sections as are appropriate to the final product being forged. Such other cross sections might include square, hexagonal, cogged, toothed, eliptical, and the like. The lower die defines an upper die guide surface 24 and aligning cam 26 surrounding the receiving region 20.

Figure 5:
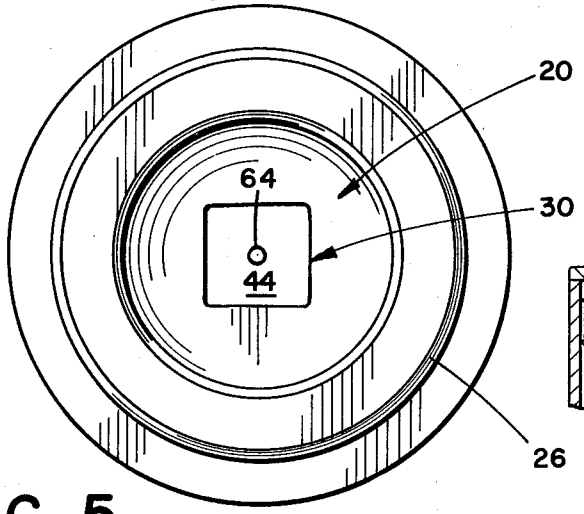

The lower die further defines a throat region 30. The throat region defines a horizontal upper surface or shelf 32 which defines the bottom portion of the billet receiving region. A rounded transition surface portion 34 between the billet receiving region and the throat region facilitates the flow of steel from the billet receiving region into the throat region. The throat region further includes a peripheral throat wall 36 which tapers inward with a draft angle 38. In the preferred embodiment, the throat region has a circular, transverse throat region cross section and a draft angle of 1.5°. However, it is contemplated that the throat region may have other cross sections, such as the square cross section illustrated in FIG. 5, as may be appropriate to the cross section of the spindle or minor diameter portion of the finished product.

The lower preforming die further defines an enlarged, relief region 40. Cylindrical side wall portions 42 define a transverse cross section of the relief region which is larger than the transverse cross section of the throat region in all dimensions. This enables the portion of the billet which is extruded through the throat region to be received in the relief region without engaging the peripheral side walls 42. The relief region is dimensioned with sufficient length between the throat region and a bottom wall 44 that the minor diameter portion of the billet does not bottom out. Bottoming out would, of course, tend to deform the billet radially making the minor diameter portion in part larger in cross section than the throat region.

With continuing reference to FIGS. 1, 2, and 3, the upper die C includes a central, billet engaging surface 50 for engaging the billet and forcing it into the lower die B. A peripheral wall 52 which defines the outer periphery of the billet engaging surface has substantially the same transverse cross section as the billet receiving region transverse cross section. This enables the upper die peripheral wall 52 to move sufficiently close to the billet receiving region defining peripheral wall 22 that no flash is defined therebetween. An outer guide wall 54 and alignment cam surface 56 selectively engage the outer guide wall 24 and alignment cam 26 of the lower die.

In use, a heated billet A from a furnace is positioned in the billet receiving region 20, as illustrated in FIG. 1. The upper preforming die is moved downward by the hydraulic press such that the billet engaging surface 50 engages the upper surface of the billet. Continued downward movement of the upper die C deforms the billet outward and downward generally into conformity with the billet receiving region. With reference to FIG. 2, continued downward movement of the upper die forces the billet into the throat region 30. Still further downward movement of the upper die causes the billet to be extruded through the throat region into the enlarged relief region 40. The portion of the billet which is extruded through the throat region has parallel outer side walls with no draft or taper.

The draft angle 38, the cross section of the throat region, and the clearance between peripheral walls 22 and 52 are selected such that the billet is more readily extruded through the throat region than between the upper and lower dies. In this manner, the billet is preformed with no flashing adjacent the interface between the upper and lower dies. The relief region 40 is configured with a longitudinal length which is sufficient that the billet does not engage the lowermost surface 44 of the region. This assures that the side walls of the spindle portion of the billet remain parallel and are not deformed outward.

With reference to FIG. 4, after the upper die C has been raised, an ejector means D ejects or otherwise removes the billet or part from the lower preform die. In the illustrated embodiment, the ejector means includes a channel 60 which is connected between a source of compressed gas 62 and a gas inlet 64 in relief region lower wall 44. To eject the preformed billet, a burst of compressed gas is introduced through the channel 60 into the relief region 40 raising the pressure therein relative to the ambient air sufficiently that the billet or part is ejected.

Optionally, the ejecting means D may include a plunger which is mechanically or pneumatically actuated to engage the lower end of the spindle portion of the billet pushing it upward.

The invention has been described with reference to the preferred embodiment. Alterations and modifications will occur to those of ordinary skill in the art upon reading and understanding the preceding detailed description of the preferred embodiment. It is intended that the invention be construed as including all such alterations and modifications insofar as they come within the scope of the appended claims or the equivalents thereof.

Having thus described the preferred embodiment, the invention is now claimed to be:

1. A method of forming a billet without draft and without flash, the method comprising:

(a) heating a billet, which billet defines at least a first cross section;

(b) positioning a lower closed die to receive the heated billet which lower die defines:

(i) a billet receiving region having a transverse billet receiving region cross section, (ii) a throat region adjacent the billet receiving region, the throat region having a transverse throat cross section which is smaller than the transverse billet receiving region cross section and smaller than the billet first cross section, and, (iii) an enlarged relief region disposed adjacent the throat region and having a transverse relief region cross section which is larger than the transverse throat cross section and having a relief region longitudinal length;

(c) positioning the heated billet in the lower die billet receiving region with the billet first cross section oriented transversely;

(d) forcing the billet partially through the throat region; and, (e) removing the billet from the lower die.

2. The method as set forth in claim 1 wherein during the forcing step, a portion of the billet is extruded through the throat region into the relief region.

3. The method as set forth in claim 2 wherein the forcing step includes pressing an upper die against the billet, the upper die having a transverse cross section which conforms to the transverse billet receiving region sufficiently that the billet is not formed therebetween to form a flash.

4. The method as set forth in claim 2 wherein a portion of the billet remains in the receiving region, which receiving region billet portion is forced into conformity with the receiving region.

5. The method as set forth in claim 2 wherein the removing step includes pressurizing the relief region.

6. The method as set forth in claim 2 wherein the receiving region billet portion is forced into a substantially circular transverse cross section.

7. The method as set forth in claim 6 wherein the extruded billet portion is extruded into a substantially circular transverse cross section.

8. The method as set forth in claim 6 wherein the extruded billet portion is extruded into a rectilinear transverse cross section.

9. A die assembly for preforming a billet without draft and without flash, the die assembly comprising:

(a) a lower closed die which defines:

(i) a billet receiving region having a transverse billet receiving cross section, (ii) a throat region operatively connected with the billet receiving region, the throat region having a transverse throat cross section which is smaller than the transverse billet receiving region cross section and smaller than the billet transverse cross section, (iii) an enlarged relief region operatively connected with the throat region and having a transverse relief region cross section which is larger than the transverse throat cross section; and, (b) an upper die including a billet engaging portion having substantially the same transverse cross section as the transverse billet receiving region cross section, the upper die billet engaging portion being slidably receivable in the lower die billet receiving region.

10. The die assembly as set forth in claim 9 wherein the throat region tapers inward at a throat region draft angle.

11. The die assembly as set forth in claim 10 wherein the draft angle is about 1.5°.

12. The apparatus as set forth in claim 9 wherein the billet receiving region transverse cross section is substantially circular.

13. The apparatus as set forth in claim 12 wherein the throat region transverse cross section is substantially circular.

14. The apparatus as set forth in claim 12 wherein the throat region transverse cross section is substantially rectilinear.

15. The apparatus as set forth in claim 14 wherein the throat portion transverse cross section is rectangular.

16. The apparatus as set forth in claim 9 further including ejecting means disposed in association with the relief region for ejecting the billet therefrom.

17. The apparatus as set forth in claim 16 wherein the ejecting means includes a compressed gas passage defined in the lower die through which compressed gas is introducable within the relief region to increase the pressure therein relative to atmospheric air.

* * * * *